United States Patent [19]

Bezjian

[11] 4,261,126

[45] Apr. 14, 1981

[54] NUMERIC DISPLAY

[76] Inventor: Krikor A. Bezjian, 24 Frederick St., Belmont, Mass. 02178

[21] Appl. No.: 17,650

[22] Filed: Mar. 5, 1979

Related U.S. Application Data

[63] Continuation-in-part of Ser. No. 949,217, Oct. 6, 1978, abandoned.

[51] Int. Cl.[3] ..... G09F 9/30

[52] U.S. Cl. ..... 40/447; 40/452; 340/759; D18/25

[58] Field of Search ..... 40/447, 448, 449, 450, 40/452, 451; 400/111; D18/25, 26; 283/17; 35/67, 69, 70, 71; 350/336; 340/756, 759, 764, 765

[56] References Cited

U.S. PATENT DOCUMENTS

| | | | |
|---|---|---|---|
| D. 204,429 | 4/1966 | Dickson | D18/26 |
| D. 217,397 | 4/1970 | Yakamoto | D18/26 |
| D. 227,602 | 7/1973 | Astle | D18/26 |
| D. 228,367 | 9/1973 | Astle | D18/26 |

FOREIGN PATENT DOCUMENTS

| | | | |
|---|---|---|---|
| 2622169 | 2/1978 | Fed. Rep. of Germany | 40/447 |
| 2739817 | 1/1979 | Fed. Rep. of Germany | 40/450 |
| 2001468 | 1/1979 | United Kingdom | 40/448 |
| 243921 | 9/1969 | U.S.S.R. | 340/756 |

*Primary Examiner*—John F. Pitrelli
*Assistant Examiner*—G. Lee Skillington
*Attorney, Agent, or Firm*—Schiller & Pandiscio

[57] ABSTRACT

A segment display wherein each segment is selectively energized to display, respectively, all numerals of the Arabian writing as distinguished from "arabic numbers". The segment display uses only seven or fewer segments for displaying all numbers by employing common use of segments for different numbers. The seven segment display readily adapts the display system to existing drive circuitry now used with seven segment displays for arabic numerals. The seven segment display enables the use of standard drive circuitry for control.

32 Claims, 34 Drawing Figures

NUMERIC DISPLAY

RELATED APPLICATION

This is a continuation-in-part of application Ser. No. 949,217 filed Oct. 6, 1978 now abandoned in favor of this continuation-in-part application.

BACKGROUND AND SUMMARY OF THE INVENTION

The present invention relates in general to a numeric display of the multiple-segment type. More particularly, this invention relates to a segment display preferably comprising seven or fewer segments for displaying numerals of the Arabian writing.

In the Near and Middle Eastern countries, such as in Iran, Pakistan and the Arab countries, a different numbering system which shall be referred to herein as the Arabian writing system, is used, as disclosed hereinafter, than the conventional numbering system used in the Western countries. In the West, numbers are displayed in Western "arabic" numerals. The display usually used to display the "arabic" numerals is a seven-segment display that is digitally controlled, usually by means of a binary code. Some consideration has been given to the display of numbers commonly used in the Arab countries. See, for example, U.S. Pat. No. 3,968,583 to Allam which discloses a twelve-segment display with all twelve segments being used in one combination or another for displaying all Arabian numerals. One disadvantage of this twelve-segment display is that the display is rather complex and requires the use of segments of narrowly restricted shape. Moreover, the twelve-segment display is not easily, if at all, adaptable for use with existing drive circuitry now used with "arabic" numerals. In general the drive circuitry used to display "arabic" numerals is for driving seven segments and thus in order to drive twelve segments a totally new circuit format is required, which would employ many more electrical leads or equivalent mechanical devices. Furthermore, the drive circuitry for the twelve segments is considerably more complex logically than for the seven-segment display. In circuit designs that employ time multiplexed addressing and/or energizing of segments, the seven-segment display has much simpler control electrical waveforms in the circuitry for their generations, than a display employing more than seven segments for a numeral.

Accordingly, it is an object of the present invention to provide a seven-segment display, and a display having fewer than seven segments for the display of all Arabian writing numerals, as distinguished from "arabic" numerals. The reduction of number of segments allows a reduction in the number of leads and simplification of the driving circuitry.

Another object of the present invention is to provide a display for Arabian writing numerals which will enable those familiar with that numeric system to read such devices as electronic watches, clocks, calculators, digital thermometers, computers, radios and any other instruments with numeric displays. The present invention is compatible with many segment display mechanisms including liquid crystal displays, light emitting diode displays, and vacuum fluorescent displays, for example.

A further object of the present invention is to provide a display for Arabian writing numerals wherein the display can be compatible with the hardware employed to drive displays for western "arabic" numerals employing seven segments. This compatibility is significant in that then like drive circuitry may be used for displaying either "arabic" numerals or Arabian writing numerals.

To accomplish the foregoing and other objects of this invention there is provided a multiple segment display for displaying numerals of Arabian writing. This display has a maximum of seven segments so as to be compatible with existing hardware drive circuitry now used for seven-segment displays of "arabic" numerals more commonly used in the Western countries. There is disclosed herein a number of different embodiments showing a variety of formats for these Arabian writing seven-segment displays. In the drawings disclosed hereinafter, these different formats are separated into seven basic groups. The majority of these groups contain seven segments for their basic arrangement but some groups can display all numerals with the use of only six segments. In accordance with the present invention the seven segment Arabian writing display is accomplished to a great extent by making common usage of some segments for deriving different numerals. For example, in the prior art, such as in the Allam patent totally different segments are used for the numerals five and eight, whereas in accordance with the present invention two segments in common, are used in deriving these two numerals in accordance with one format of the present invention.

Another important feature of the present invention is that the numerals in each format are displayed in substantially the same position while in the prior art such as in the Allam patent where as many as twelve segments are used, different numerals shift positions when displayed. For example, the numeral five is displayed at the right side of the display in the Allam patent, while the numeral eight is displayed at the left side of the display. Thus, the prior art construction does not at all lend itself to multiple numeral displays wherein it is important that the spacing between numerals remains substantially constant. Also another advantage of the invention is that multi-digit numbers can now be displayed more compactly which is important for such displays as calculator displays.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
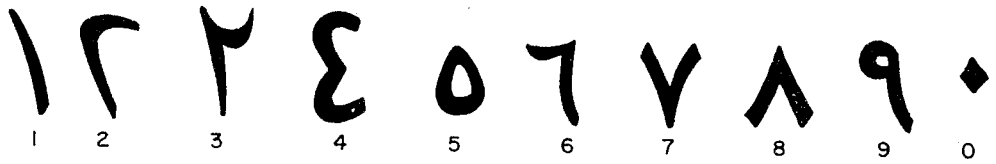
FIG. 1 shows hand written Arabian writing numerals.
Figure 2:
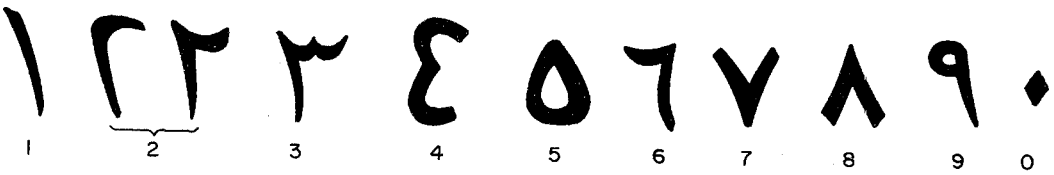
FIG. 2 shows typewritten Arabian writing numerals.

FIG. 1 shows a first number system including the numbers one to nine and zero. The number system of FIG. 1 is for hand written Arabian numerals. FIG. 2 shows a second number system similar to the one shown in FIG. 1 and which may be used for typewritten Arabian numerals or either hand written or typewritten Iranian. The primary difference between the two number systems is in the representation of numerals two and three. FIGS. 3–28 show a number of different embodiments for the segment display in accordance with this invention. Each of the FIGS. 3–28 have associated therewith tables 3–28, respectively, indicating the segment or segments illuminated or operated for each numeral.

The exact shape, size, curvature and angles of the segments of the designs depicted in FIGS. 3–34 and described in the test are not considered as limiting the definition of the designs. The designs described in the text can be altered to include segments of various curvature and styles, including, in some cases designs constructed of completely straight segments.

Figure 3:
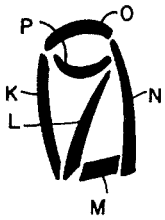
FIGS. 3–28 and 32–34 show individual distinct formats for the segment display in accordance with this invention.

With regard to FIG. 3, Table 3 shows the segment or segments that are selected for displaying each of the numerals. These include segments K, L, M, N, O and P. The embodiment of FIG. 3 is for displaying a numeral system as depicted in FIG. 1.

In FIG. 3 segment K is a somewhat curved, vertical segment on the left side of the character field. Segment N is a somewhat curved, vertical segment on the right side of the character field and segment M is a nearly linear segment on the bottom of the character field extending from near the bottom of segment K to the bottom of segment N, and segment L is a nearly linear segment extending diagonally from the bottom left of the character field, near the bottom end of segment K towards the upper right of the character field, near the top end of segment N. Segment P is a concave shaped segment, with its concavity pointing toward the top of the character field, extending from the vicinity of the top of segment K to the vicinity of the top of segment N. Segment O is a concave segment, located above segment P, with its concavity pointing toward the bottom of the character field, extending from the vicinity of the top of segment K to the vicinity of the top of segment N.

In FIG. 3 it is noted that there are only six segments required for the display of all ten numerals. In comparison, the Allam U.S. Pat. No. 3,968,583 twelve different segments are employed for displaying the like number of numerals. In accordance with the present invention, common usage is made of many of the segments so that a fewer number of segments can be used for displaying all numerals. For example, in the Allam patent three segments are used for displaying the numeral five and two other segments are used for displaying the numeral eight. However, in accordance with the present invention two segments, used for displaying the numeral five are also used for displaying the numeral eight. More specifically, in FIG. 3 the numeral five is displayed by selecting segments L, M and N. The numeral eight is provided by the selection of segments L and N. Thus, the segments L and N are common to both of these numerals. Another common usage includes, for example, the numerals four and nine. In the Allam patent they use totally different segments for these numerals.

FIG. 3 represents a first format in a first group, designated herein as group G1. The format of group G1 also includes FIGS. 4–8 and 32. Group G2 is shown in FIGS. 9–13 and 33, group G3 in FIGS. 14–17 and 34, group G4 in FIG. 18, group G5 in FIGS. 10–23, group G6 in FIG. 24 and group G7 in FIGS. 25–28. The formats of the segments are separated into these groups because of the similar arrangement of a majority of the segments in each of these groups. For example, in group G1 all of the formats include the segments K, L, M, N, O and P. For example, the format of FIG. 4 differs only in the addition of the segment Q making FIG. 4 thus a seven-segment display while FIG. 3 represents a six-segment display. In both FIGS. 3 and 4 as an example, it is noted that the individual segments identified alphabetically are arranged in substantially the same position and has substantially the same length and shape.

In accordance with the present invention the segments can be of relatively simple configuration not requiring complex curvatures and shapes. Many of the segments can be linear while other segments can have more or less a curvature to them. With regard to FIG. 3, for example, the segment K is substantially linear while the segment O is arcuate.

Associated with each of the formats depicted in FIGS. 3–28 and 32–34 there are corresponding tables 3–28 and 32–34, respectively. Each of these tables lists the numerals that can be displayed by the associated format and also the particular segments that are driven or made visible to derive each of the separate numbers. It is believed that each of these tables is relatively self-explanatory and a description of a limited number of the tables is undertaken herein. Thus, in FIG. 3 the numeral one can be displayed by driving either segments K, N or L. The numeral five is displayed by selection of the segments L, M and N. The format of FIG. 3 is for displaying a numeral system as depicted in FIG. 1.

Figure 4:
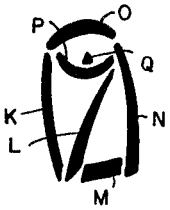

The format shown in FIG. 4 and associated table 4 is quite similar to the format of FIG. 3 with the addition of one more segment Q which can be used for display of three and display alone of the numeral zero. The table of driven segments shown in FIG. 4 is substantially the same as the table of FIG. 3. The format of FIG. 4 can display typewritten arabian numerals as opposed to FIG. 3 which is primarily for handwritten arabian writing.

Figure 5:
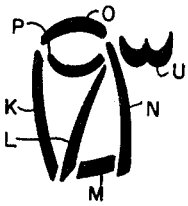

The format of FIG. 5 and associated table 5 is also in group G1. This format includes segments K, L, M, N, O and P which are the primary six segments of this group and with the use of the additional segment U. As noted the segment U is used in association with the segment N for the typewritten numeral 3 otherwise the segments that are driven represented in table 5 are substantially the same as in table 3.

Figure 6:
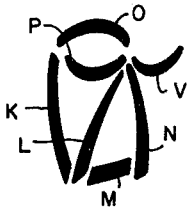

The format of FIG. 6 and corresponding table 6 is also in group G1 and includes the basic segments of this group along with the additional segment V. As noted in table 6 the segment V may be used in connection with deriving numerals 2 and 3.

Figure 7:
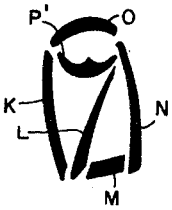

FIG. 7 and corresponding table 7 represent another format of the first group G1. This format includes only six segments with the segment P, such as shown in FIG. 3 replaced by a differently shaped, double concave segment P'. This format is similar to the design of FIG. 3 but is used for typewritten numbers rather than hand written. Similarly, the formats in FIGS. 4–6 are for typewritten arabian numerals.

Figure 8:
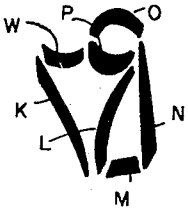

FIG. 8 and corresponding table 8 represent another format of group G1 including, in addition to the basic six segments, the added segment W disposed between a top end of segment K and the left end of segment P. This format is for typewritten numerals and the format of FIG. 8 is quite similar to the format of FIG. 7 except that the single segment P' in the format of FIG. 7 is replaced by two segments P and W in FIG. 8. The segment W, as noted from table 8, is used in deriving the numerals 2, 3 and possibly the numeral zero.

Figure 9:
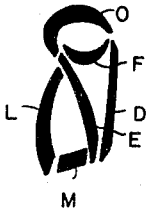

FIGS. 9–13 illustrate formats in a second group G2 wherein the segments that are common in the group include segments E, F, D, L, M and O. FIG. 9 and corresponding table 9 show the basic format for this group including only the basic segments. Again, the corresponding table 9 is believed to be self-explanatory as to the segments that are driven or illuminated for deriving each of the different numerals. It is also noted in the second group that there are some segments that are common to the first group depicted in FIGS. 3–8. These common segments between groups include segments L, M and O. In FIG. 9 the segment D appears to correspond to the segment N, however, the segment D is not used in the numeral five in the format of FIG. 9 whereas the segment N is used in the format of FIG. 3 in the numeral five.

In FIG. 9 segment D is a nearly linear, nearly vertical segment on the right side of the character field, and segment L is a somewhat curved, nearly vertical segment on the left side of the character field, which is possibly somewhat shorter than segment D, but which extends approximately the same distance to the bottom of the character field as segment D. Segment E is a somewhat curved segment that extends diagonally across the character field, such that the lower right end of segment E is located near the lower end of segment D and the upper left end of segment E is located just above the upper end of segment L. Segment M is a nearly linear segment located at the bottom of the character field, whose left end is near the bottom end of segment L and whose right end is near the bottom ends of segments E and D, and segment F is a concave-shaped segment, with its concavity pointing towards the top of the character field, and extending from the vicinity of the top end of segment L to the vicinity of the top end of segment D. Segment O is a concave shaped segment, located above segment F, with its concavity pointing toward the bottom of the character field, and extending from the vicinity of the top end of segment L to the vicinity of the top of segment D.

Figure 10:
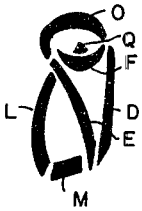

The format of FIG. 10 and corresponding table 10 is quite similar to the format of FIG. 9 with the use of the six basic segments E, F, D, L, M and O, and the added segment Q. It is noted from table 10 that the segment Q may be used in deriving numerals three and zero.

Figure 11:
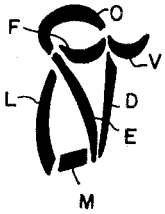

The format of FIG. 11 and corresponding table 11 is another format from group G2 which again includes the six basic segments of this group along with the added segment V. The segment V, as noted in table 11 may be used in deriving the numerals two, three and zero.

Figure 12:
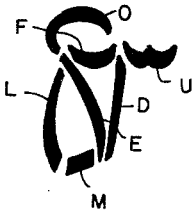
Figure 13:
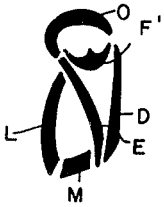

The format of FIG. 12 and corresponding table 12 is also in group G2 including the six basic segments and the added segment U. The segment U differs from the segment V of FIG. 11 in its double concavity which is usable in particular for typewritten Arabian numerals in deriving the numeral three. In this regard it is noted that the format of FIG. 9 is used for deriving hand written Arabian numerals while the formats of FIGS. 10 and 11 are for deriving typewritten Arabian numerals. FIG. 13 represents the last format of group G2. Corresponding table 13 shows the segments that are driven or illuminated for each of the numerals. The format of FIG. 13 is substantially the same as the format of FIG. 9 with the exception of the use of a segment F′ in place of the segment F shown in FIG. 9. Whereas the format of FIG. 9 is for handwritten arabian numerals, the format of FIG. 13 is for typewritten arabian numerals and thus that is the basic reason for the substitution of the double concavity segment F′ in place of the segment F shown in FIG. 9. With regard to FIG. 13 the segment F′ can be used in deriving numerals 3, 6 and 9.

Figure 14:
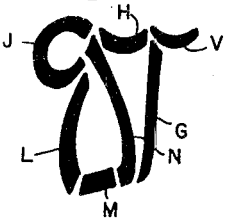
Figure 15:
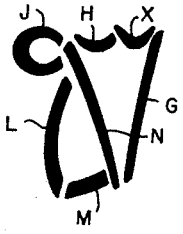
Figure 16:
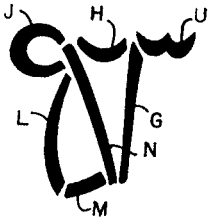
Figure 29:
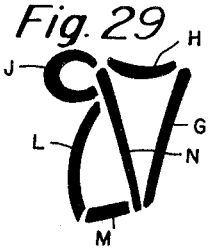
FIGS. 29–31 show master formats for groups G3, G5 and G7 as explained in more detail hereinafter.

A third group, identified herein as group G3 is depicted in FIGS. 14–17 and 34. This format also includes six basic segments, namely segments G, H, J, L, M and N. FIG. 29 depicts the arrangement of these six basic segments of group 3. FIG. 14 shows these six basic segments along with segment V. Again, in the embodiments of group G3, it is believed that the tables are self-explanatory. The segment V shown in FIG. 14 may be employed in deriving the numerals 2 and 3. The formats shown in this group depicted in FIGS. 14–16 are all for displaying typewritten arabian numerals. Thus, with regard to these formats and their associated tables reference is made in particular to FIG. 2 rather than to FIG. 1.

In FIGS. 14 and 29 segment G is a nearly linear segment located on the right side of the character field that can be tilted, from the bottom to the top, somewhat towards the right, and segment N is a somewhat curved segment that extends diagonally from the vicinity of the bottom end of segment G up and towards the left, being almost equally as long as segment G. Segment L is a somewhat curved segment, somewhat parallel in orientation to segment G, that is located on the left side of the character field and extends from the vicinity of the upper end of segment N to the lower left hand corner of the character field. Segment M is a nearly linear segment located at the bottom of the character field, whose left end is near the bottom end of segment L and whose right end is near the bottom ends of segments N and G. Segment H is a nearly horizontal segment with a concave curvature that points toward the top of the character field, whose left end is near the top of segment N and whose right end is near the top of segment G. Segment V is somewhat similar in shape to segment H, being a nearly horizontal segment with a slight concave curvature that points toward the top of the character field and which extends from the top end of segment G to the upper right corner of the character field. Segments V, H and N are situated such that they will display arabian typewritten numeral three. Segment J is a partial loop with nearly circular curvature, which is open on its right side and which extends from near the top end of segment N to the top end of segment L.

FIG. 15 shows the six basic segments G, H, J, L, M and N, and the added segment X adjacent to the segment H. The segment X is primarily used in deriving the numbers three and six. It is noted that the formats of group G3 have common segments to both groups G1 and G2 such as segments L and M.

FIG. 16 represents another format of group G3 and has associated therewith the corresponding table 16. Again, this format includes the six basic segments and the additional segment U which is used in place of the segment V of FIG. 14. The segment U which is the same segment previously shown in FIG. 12, is a double concave segment which is used primarily in deriving the numeral three.

Figure 17:
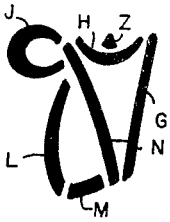

FIG. 17 shows another format of group G3 using the segment Q. The segment Q is used along with the other six basic segments of this group for deriving, for example, numerals three and possibly zero.

Figure 18:
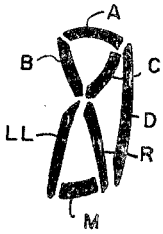

Group G4 comprises basically only one format depicted in FIG. 18 including seven basic segments as depicted in FIG. 18. These segments include segments A, B, C, D, LL, M and R. The table 18 associated with FIG. 18 is self-explanatory and shows the groups of segments that are illuminated to create each of the separate numerals. In this group there is one segment M that is common to the three preceding groups.

In FIG. 18 segment D is a nearly linear, nearly vertical segment on the right side of the character field. Segment R is a nearly linear segment that extends diagonally upward to the left from near the bottom left side of segment D to the center region of the character field. Segment C is a nearly linear segment that extends diagonally upward to the right from near the upper end of segment R in the center region of the character field to near the upper end of segment D. Segment LL is a nearly linear segment that extends diagonally downward to the left from near the upper end of segment R and the lower end of segment C in the center region of the character field to the lower left corner of the character field. Segment M is a nearly linear segment located near the bottom of the character field that extends from near the lower end of segment LL to near the lower end of segment R. Segment B is a nearly linear segment that extends diagonally upward to the left from near the upper end of segment LL and the upper end of segment R and the lower end of segment C, all in the center region of the character field, to the upper left corner of the character field. Segment A is a nearly linear or slightly curved segment located near the top of the character field that extends from near the upper end of segment B to near the upper ends of segments C and D.

Figure 19:
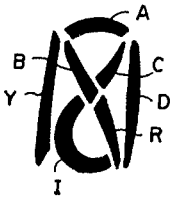
Figure 30:
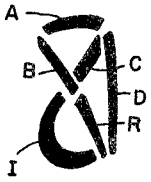

FIGS. 19–23 represent still a further group G5 having six basic segments A, B, C, D, I and R. The six basic segments of group G5; A, B, C, D, I and R are depicted in FIG. 30. In addition to these basic segments, FIG. 19 also shows a segment Y which is usable in deriving the numerals one, two and three. Again, table 19 associated with FIG. 19 is believed to be self-explanatory with regard to the particular segments that are used for each of the different numerals.

In FIGS. 19 and 30 segment D is a nearly linear, nearly vertical segment located on the right side of the character field. Segment R is a nearly linear segment that extends diagonally upward to the left from near the bottom left side of segment D in the lower right corner of the character field to the center region of the character field. Segment C is a nearly linear segment that extends diagonally upward to the right from near the upper end of segment R in the center region of the character field to near the upper end of segment D in the upper right corner of the character field. Segment B is a nearly linear segment that extends diagonally upward to the left from near the upper end of segment R and the lower end of segment C in the center region of the character field, to the upper left corner of the character field. Segment I is a segment of approximately ellipsoidal or circular curvature with an open side on the right that extends from near the lower end of segment R in the lower right corner of the character field to near the upper end of segment R and the lower ends of segments B and C in the center region of the character field. Segment A is a nearly linear segment located near the top of the character field that extends from near the upper end of segment B in the upper left of the character field to near the upper ends of segments C and D in the upper right of the character field.

Figure 20:
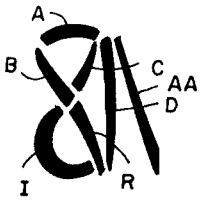
Figure 21:
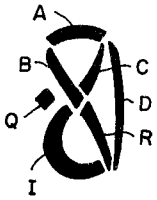
Figure 22:
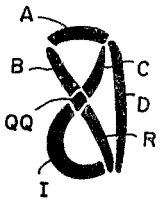

FIG. 20 is a second format of group G5 again using the six basic segments and an additional segment AA in place of the segment Y shown in FIG. 19. In FIG. 20 the additional segment AA is usable in deriving the numerals 1, 6, 8 and 9. The formats of FIGS. 18–20 and also of FIGS. 21 and 22 are used for handwritten arabian numerals. The format of FIG. 23 is used for typewritten arabian numerals.

FIG. 21 also uses the six basic segments of this group, G5, namely A, B, C, D, I and R along with segment Q. Segment Q is used primarily for deriving the numeral zero. The segment Q, as used in the design depicted in FIG. 21 can be located almost anywhere within the character field of the display. Its placement in FIG. 21 is only one of the possible choices for its location. FIG. 22 and corresponding table 22 show still another format of group G5 including, in addition to the basic six segments, a segment QQ which is arranged centrally of the segments B, C, I and R. This segment QQ can be used in deriving substantially all of the numerals with the exception of numeral six.

Figure 23:
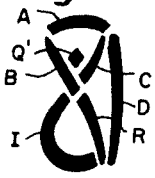

Finally, FIG. 23 represents the last format of group G5 including, in addition to the six basic segments, a segment Q′ which is primarily only used for deriving the number zero. Actually, the Q′ segment may be disposed as shown between segments A, B and C but could also be shown arranged between segments C, D, and R or segments I and R. In the embodiment of FIG. 23 the segment Q′ is also usable in deriving the number three as the version 23 is for typewritten arabian numerals.

Figure 24:
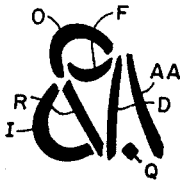

The group G6 is represented only by the format of FIG. 24, although, there are segments in this group shown in FIG. 24 and corresponding table 24 that are common to segments of other groups. These segments are similarly alphabetically identified. The format in FIG. 24 comprises the seven basic segments disclosed therein including segments D, F, I, O, R, Q and AA. Table 24 is self-explanatory as far as the segments are concerned for providing each numeral. The format of FIG. 24 is for handwritten arabian numerals. The segment Q, as used in the design depicted in FIG. 24, can be placed almost anywhere in the character field of the display. Its placement in FIG. 24 is only one of the possible choices for its location.

In FIG. 24 segment D is a nearly linear, nearly vertical segment located on the right side of the character field. Segment R is a nearly linear segment that extends diagonally upward to the left from near the bottom left side of segment D to the center region of the character field. Segment I is a segment of approximately ellipsoidal or circular curvature with an open side on the right that extends from near the lower end of segment R to near the upper end of segment R in in the center region of the character field. Segment F is a segment of concave curvature with concavity pointing upward that extends from near the upper ends of segments I and R in the center region of the character field to near the upper end of segment D in the upper right corner of the character field. Segment O is a segment of concave curvature located near the top of the character field with concavity pointing downward that extends from near the upper ends of segments I and R in the center region of the character field and the left end of segment F to near the upper end of segment D and the right end of segment F in the upper right corner of the character field. Segment AA is a nearly linear segment that extends diagonally downward from near the upper end of segment D to the lower right corner of the character field. Segment Q is a relatively short segment of many possible shapes, including circular, rhomboidal, rectangular shapes etc., that can be located almost anywhere in the character field or can be combined in many ways to be essentially an extension of any of the other segments of the display format.

Figure 31:
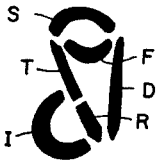

FIGS. 25–28 represent the last group G7 which is characterized by six common segments, namely segments, D, F, I, R, S, and T, as depicted in FIG. 31. These formats are for handwritten arabian numerals. In addition to these basic segments, in FIG. 25 and corresponding table 25 there is provided a segment AA. This segment AA is usable for deriving the numbers one, six, eight and nine.

Figure 25:
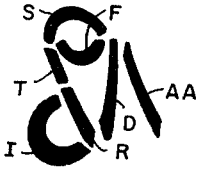

In Group G7, of FIGS. 25 and 31 segment D is a nearly linear, nearly vertical segment located on the right side of the character field. Segment R is a nearly linear segment that extends diagonally upward to the left from near the bottom left side of segment D to the center region of the character field. Segment I is a segment of approximately ellipsoidal or circular curvature with an open side on the right that extends from near the lower end of segment R to near the upper end of segment R in the center region of the character field. Segment T is a nearly linear segment that extends diagonally up toward the left from near the upper ends of segments I and R in the center region of the character field to the vicinity of the upper left corner of the character field. Segment F is a segment of concave curvature with concavity pointing upward that extends from near the upper end of segment T in the upper left area of the character ifeld to near the upper end of segment D in the upper right corner of the character field. Segment S is a segment of concave curvature located near the top of the character field and above segment F, with concavity pointing downward that extends from near the upper end of segment T and the left end of segment F to near the upper end of segment D and the right end of segment F in the upper right corner of the character field. Segment AA is a nearly linear segment that extends diagonally downward from the upper end of segment D to the lower right corner of the character field.

Figure 26:
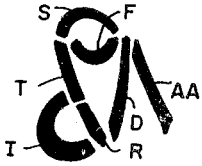

FIG. 26 shows a format that is substantially the same as the format of FIG. 25 as far as the segments are concerned with the exception that the segment R shown in FIG. 26 is shorter than the corresponding segment in FIG. 25. It is also noted that the options set forth in table 26 differ slightly from those shown in table 25 in particular with respect to deriving the numeral seven. With the version of FIG. 25 only two segments can be used for number seven whereas in the version of FIG. 26, three segments are desirable.

Figure 27:
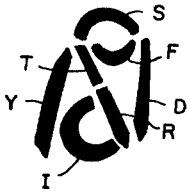
Figure 28:
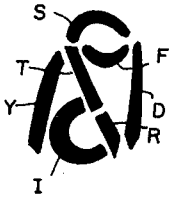

FIGS. 27 and 28 with corresponding tables 27 and 28, show the final formats for groups G7 including, in addition to the six basic segments, a segment Y. Segment Y is usable in deriving numerals one and eight. In FIG. 28 the segment R is shorter than segment R depicted in FIG. 27, making corresponding segment T somewhat longer. In the version of FIG. 28, the numeral seven requires selection of all segments T, R, and D.

The segments of each format are shown schematically herein and may be physically constructed from many different types of light emitting sources such as light emitting diodes, planar plasma discharge devices, simple plasma displays, fluorescent devices, gas discharge devices, or liquid crystal type displays. The segments can be directly driven by voltage signals either with the segment devices being constructed in a common anode configuration or a common cathode configuration or any other suitable scheme. To produce a row or array of numerical symbols the required number of seven segment displays can be driven together. Time multiplexing schemes could be employed wherever desired.

The number system shown in FIG. 1 is basically handwritten arabian while the number system shown in FIG. 2 is typewritten arabian. In Iranian both handwritten and typewritten appear as in FIG. 2 but using only the second shown numeral for the number 2. There are some other differences between the specific number systems although most of these differences are slight. For example, the Arabs generally use a comma for a decimal point while the Persians generally use a slash for the decimal point.

It is also noted that the segment Q, as shown in, for example, FIG. 2, may be placed in many different locations other than specifically shown herein. For example, in another format as depicted in FIG. 24, the segment Q is lower in the display. In some of the designs, segment Q can also constitute part of another segment. The corresponding table can then be modified in such a way that the segment Q can also be driven when the related segment is driven.

In FIGS. 3–28 certain ones of the formats are considered to be master formats. In fact, in FIGS. 3–28 there are four such master formats out of a total of seven master formats. FIGS. 29–31 show the additional three master formats. For group G1 the master format is shown in FIG. 3. For group G2 the master format is shown in FIG. 9. For group G3 the master format is shown in FIG. 29. For group G4 the master format is shown in FIG. 18. For group G5 the master format is shown in FIG. 30. For group G6 the master format is shown in FIG. 24. For group G7 the master format is shown in FIG. 31.

Figure 32:
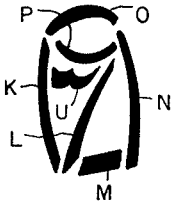
Figure 33:
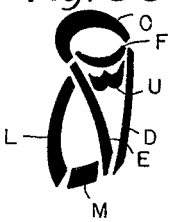
Figure 34:
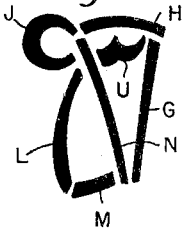

FIGS. 32–34 show three additional formats. The format shown in FIG. 32 is a format in group G1. The format shown in FIG. 33 is associated with group G2. The format of FIG. 34 is associated with group G3. In connection with FIGS. 32–34 reference is also made to the corresponding respective tables 32–34. With regard to FIG. 32, the format shown thereis in similar to the master format of FIG. 3 with the addition of the segment U. It is noted in FIG. 5 that the segment U is included externally of the basic format whereas in the preferred version of FIG. 32 the segment U is disposed between segments L, K and P. With regard to FIG. 33 reference is made to the master format of FIG. 9 including the basic segments D, E, F, L, M and O. In FIG. 33, in addition to these basic segments in the master format there is also the segment U. In this connection a segment U is also shown in FIG. 12 but this segment is external of the basic format. On the other hand in the arrangement of FIG. 33 the segment U is disposed in the triangle formed by segments D, E, and F. Finally, FIG. 34 shows a format of group G3. The master for this format is shown in FIG. 29 including segments G, H, J, L, M and N. In addition to these basic segments there is also provided the segment U. The segment U is disposed in the triangular area defined by segments G, H and N. Tables 32–34 are believed to be self-explanatory with regard to the numerals that are displayed in each format. Basically, in all three formats of FIGS. 32–34 the segment U is used in connection with the numeral 3.

TABLE 3

(For handwritten Arabian numerals)

| NUMERAL | SEGMENTS |
|---|---|
| one | K, or N, or L |

TABLE 3-continued (For handwritten Arabian numerals)

| NUMERAL | SEGMENTS |
|---|---|
| two | O and K |
| three | P and K |
| four | O, P, L and M |
| five | L, M and N |
| six | P and N, or P and L, or O and N |
| seven | K and L |
| eight | L and N |
| nine | O, P and N, or O, P and L |
| zero | M |

TABLE 4

(For Typewritten Arabian numerals)

| NUMERAL | SEGMENTS |
|---|---|
| one | K, N or L |
| two | O and K, or P and K |
| three | P, K and Q |
| four | O, P, L and M |
| five | L, M and N |
| six | P and N, or P and L, or O and N |
| seven | K and L |
| eight | L and N |
| nine | O, P and N, or O, P and L |
| zero | M or Q |

TABLE 5

(For typewritten Arabian numerals)

| NUMERAL | SEGMENTS |
|---|---|
| one | K, N or L |
| two | O and K, or P and K |
| three | N and U |
| four | O, P, L and M |
| five | L, M and N |
| six | P and N, or P and L, or O and N |
| seven | K and L |
| eight | L and N |
| nine | O, P and N or O, P and L |
| zero | M |

TABLE 6

(For typewritten Arabian numerals)

| NUMERAL | SEGMENTS |
|---|---|
| one | K or N or L |
| two | O and K, or P and K, or L and V or N and V |
| three | P, K and V |
| four | O, P, L and M |
| five | O, M and N |
| six | P and N, or P and L |
| seven | K and L |
| eight | L and N |
| nine | O, P and N, or O, P and L |
| zero | M |

TABLE 7

(For Typewritten Arabian numerals)

| NUMERAL | SEGMENTS |
|---|---|
| one | K or N or L |
| two | O and K |
| three | P' and K |
| four | O, P', L and M |
| five | L, M and N |
| six | P' and N or P' and L, or O and N |
| seven | K and L |
| eight | L and N |
| nine | O, P' and N, or O, P' and L |
| zero | M |

TABLE 8

(For Typewritten Arabian numerals)

| NUMERAL | SEGMENTS |
|---|---|
| one | K or N or L |
| two | W and K |
| three | P, K and W |
| four | O, P, L and M |
| five | L, M and N |
| six | P and N, or P and L, or O and N |
| seven | K and L |
| eight | L and N |
| nine | O, P and N, or O, P and L |
| zero | M or W |

TABLE 9

(For Handwritten Arabian numerals)

| NUMERAL | SEGMENTS |
|---|---|
| one | E or D or L |
| two | O and E |
| three | E and F or L and F |
| four | O, L and M |
| five | L, E and M |
| six | F and D |
| seven | E and D |
| eight | L and E |
| nine | O, F and D |
| zero | M |

TABLE 10

(For Typewritten Arabian writing)

| NUMERAL | SEGMENTS |
|---|---|
| one | E or D or L |
| two | O and E, or F and E |
| three | E, F and Q |
| four | O, L and M |
| five | L, E and M |
| six | F and D |
| seven | E and D |
| eight | L and E |
| nine | O, F and D |
| zero | M or Q |

TABLE 11

(For Typewritten Arabian numerals)

| NUMERAL | SEGMENTS |
|---|---|
| one | E, D or L |
| two | O, E or F, E or V, D |
| three | E, F and V |
| four | O, L and M |
| five | L, E and M |
| six | F and D |
| seven | E and D |
| eight | L and E |
| nine | O, F and D |
| zero | M or V |

TABLE 12

(For Typewritten Arabian numerals)

| NUMERAL | SEGMENTS |
|---|---|
| one | E, or D, or L |
| two | O, E or F, E |
| three | U and D |
| four | O, L and M |
| five | L, E and M |
| six | F and D |
| seven | E and D |
| eight | L and E |
| nine | O, F and D |
| zero | M |

TABLE 13

(For Typewritten Arabian numerals)

| NUMERAL | SEGMENTS |
|---|---|
| one | E, D or L |
| two | O and E |
| three | E and F' or L and F' |
| four | O, L and M |
| five | L, E and M |
| six | F' and D, or O and D |
| seven | E and D |
| eight | L and E |
| nine | O, F' and D |
| zero | M |

TABLE 14

(For Typewritten Arabian numerals)

| NUMERAL | SEGMENTS |
|---|---|
| one | N, L or G |
| two | N and H, or V and G |
| three | N, H and V |
| four | J, L and M |
| five | L, M and N |
| six | H and G |
| seven | N and G |
| eight | L and N |
| nine | J and N, or J and L |
| zero | M or H |

TABLE 15

(For Typewritten Arabian numerals)

| NUMERAL | SEGMENTS |
|---|---|
| one | N, L or G |
| two | N and H |
| three | N, H and X |
| four | J, L and M |
| five | L, M and N |
| six | X and G |
| seven | N and G |
| eight | L and N |
| nine | J and N, or J and L |
| zero | M or H |

TABLE 16

(For Typewritten Arabian numerals)

| NUMERAL | SEGMENTS |
|---|---|
| one | N, L or G |
| two | N and H |
| three | U and G |
| four | J, L and M |
| five | L, M and N |
| six | H and G |
| seven | N and G |
| eight | L and N |
| nine | J, N or J, L |
| zero | M or H |

TABLE 17

(For Typewritten Arabian numerals)

| NUMERAL | SEGMENTS |
|---|---|
| one | N, L or G |
| two | N and H |
| three | N, H and |
| four | J, L and M |
| five | L, M and N |
| six | H and G |
| seven | N and G |
| eight | L and N |
| nine | J, N or J, L |
| zero | M or Q |

TABLE 18

(For Handwritten Arabian numerals)

| NUMERAL | SEGMENTS |
|---|---|
| one | D, or B and R |
| two | A, B and R |
| three | B, C and R |
| four | A, B, LL and M |
| five | LL, M and R |
| six | A and D, or A, C and LL |
| seven | B, R, D, or R and D |
| eight | LL, C, D or C and D |
| nine | A, B, C, and D |
| zero | M |

TABLE 19

(For Handwritten Arabian numerals)

| NUMERAL | SEGMENTS |
|---|---|
| one | D, Y or B and R |
| two | A, B, R, or A and Y |
| three | B, C, R or Y, B, C |
| four | A, B and I |
| five | I and R |
| six | A and D |
| seven | B, R, D, or R and D |
| eight | Y, B, R or C and D |
| nine | A, B, C and D |
| zero | B, C, or R |

TABLE 20

(For Handwritten Arabian numerals)

| NUMERAL | SEGMENTS |
|---|---|
| one | D, or AA, or B and R |
| two | A, B and R |
| three | B, C and R |
| four | A, B and I |
| five | I and R |
| six | A and D, or A and AA |
| seven | B, R and D, or R and D |
| eight | D and AA, or C and D |
| nine | A, B, C and D or A, B, C, and AA |
| zero | B, C, or R |

TABLE 21

(For Handwritten Arabian numerals)

| NUMERAL | SEGMENTS |
|---|---|
| one | D, or B and R |
| two | A, B and R |
| three | B, C and R |
| four | A, B and I |
| five | I and R |
| six | A and D |
| seven | B, R, D, or R and D |
| eight | C and D |
| nine | A, B, C and D |
| zero | Q or R |

TABLE 22

(For Handwritten Arabian numerals)

| NUMERAL | SEGMENTS |
|---|---|
| one | D, or B, QQ and R |
| two | A, B, R and QQ |
| three | B, C, R and QQ |
| four | A, B, I, and QQ or A, B and I |
| five | I, R and QQ, or I and R |
| six | A and D |
| seven | B, R, D and QQ |
| eight | C, D and QQ or C and D |
| nine | A, B, C, D and QQ or A, B, C and D |
| zero | QQ or R |

TABLE 23

(For Typewritten Arabian numerals)

| NUMERAL | SEGMENTS |
|---|---|
| one | D, or B and R |
| two | A, B and R |
| three | B, C, R and Q' |
| four | A, B and I |
| five | I and R |
| six | A and D |
| seven | B, R and D, or R and D |
| eight | C and D |
| nine | A, B, C and D |
| zero | Q' or R |

TABLE 24

(For Handwritten Arabian numerals)

| NUMERAL | SEGMENTS |
|---|---|
| one | AA, R or D |
| two | O and R |
| three | F and R |
| four | O and I |
| five | I and R |
| six | F and AA, or F and D |
| seven | R and D |
| eight | D and AA |
| nine | O, F, D, or O, F, AA |
| zero | Q |

TABLE 25

(For Handwritten Arabian numerals)

| NUMERAL | SEGMENTS |
|---|---|
| one | AA, or T and R, or D |
| two | S, T and R |
| three | F, T and R |
| four | S, T and I |
| five | I and R |
| six | F, AA, or F, D, or S, AA |
| seven | T, R and D, or R and D |
| eight | D and AA |
| nine | S, F, D or S, F, AA |
| zero | T |

TABLE 26

(For Handwritten Arabian numerals)

| NUMERAL | SEGMENTS |
|---|---|
| one | AA, or T and R, or D |
| two | S, T and R |
| three | F, T and R |
| four | S, T and I |
| five | I and R |
| six | F, AA, or F, D, or S, AA |
| seven | T, R and D |
| eight | D and AA |
| nine | S, F and D, or S, F and AA |
| zero | T or R |

TABLE 27

(For Handwritten Arabian numerals)

| | |
|---|---|
| one | T and R, or D or Y |
| two | S, T and R |
| three | F, T and R |
| four | S, T and I |
| five | I and R |
| six | F and D |
| seven | T, R and D, or R and D |
| eight | Y, T and R |
| nine | S, F and D |
| zero | T or R |

TABLE 32

(For Typewritten Arabian Numerals)

| NUMERAL | SEGMENTS |
|---|---|
| one | K or N or L |
| two | O and K, or P and K |
| three | K and U |
| four | O and P and L and M |
| five | L and N and M |
| six | P and N, or P and L, or O and N |
| seven | K and L |
| eight | L and N |
| nine | O and P and N, or O and P and L |
| zero | M |

TABLE 33

(For Typewritten Arabian Numerals)

| NUMERAL | SEGMENTS |
|---|---|
| one | E, or D, or L |
| two | F and E, or O and E |
| three | E and U |
| four | O and L and M |
| five | L and E and M |
| six | F and D |
| seven | E and D |
| eight | L and E |
| nine | O and F and D |
| zero | M |

TABLE 28

(For Handwritten Arabian numerals)

| NUMERAL | SEGMENTS |
|---|---|
| one | T and R, or D or Y |
| two | S, T and R |
| three | F, T and R |
| four | S, T and I |
| five | I and R |
| six | F and D |
| seven | T, R and D |
| eight | Y, T and R, or Y and T |
| nine | S, F and D |
| zero | T or R |

TABLE 34

(For Typewritten Arabian Numerals)

| NUMERAL | SEGMENTS |
|---|---|
| one | N, L, or G |
| two | N and H |
| three | N and U |
| four | J, L and M |
| five | L, M and N |
| six | H and G |
| seven | N and G |
| eight | L and N |
| nine | J and N, or J and L |
| zero | M |

What is claimed is:

1. A multiple segment display comprising a minimum of six and a maximum of seven selectively energizable segments, said segments being shaped and positioned relative to one another in a predetermined array so that each numeral of the type used in Arabian writing can be selectively displayed, wherein said array comprises segments K, L, M, N, O, P as shown in any one of the FIGS. 3–8, inclusive, and 32 of the drawings.

2. A display as set forth in claim 1, wherein segments L and N are selectively energized for displaying the numeral in Arabian writing corresponding to the numeral 8, and segments L, N and M are selectively energized for displaying the numeral in Arabian writing corresponding to the numeral 5.

3. A display according to claim 1, wherein segments O and P are selectively energized when displaying each of the numerals in Arabian writing corresponding respectively to numerals 4 and 9.

4. A display according to claim 1, wherein segments L and M are selectively energized when displaying each of the numerals in Arabian writing corresponding respectively to numerals 4 and 5.

5. A display according to claim 1, wherein segments K and L are selectively energizable for displaying the numeral in Arabian writing corresponding to numeral 7, segments L and N are selectively energizable for displaying the numeral in Arabian writing corresponding to the numeral 8, segments L, M and N are selectively energizable for displaying the numeral in Arabian writing corresponding to the numeral 5, segments O, P and L are selectively energized for displaying the numeral in Arabian writing corresponding to the numeral 4.

6. A display according to claim 1, further including the segment U selectively energizable with segment K for displaying the numeral in Arabian writing corresponding to numeral 3.

7. A multiple segment display comprising a minimum of six and a maximum of seven selectively energizable segments, said segments being shaped and positioned relative to one another in a predetermined array so that each numeral of the type used in Arabian writing can be selectively displayed, wherein said array comprises segments E, F, D, L, M and O as shown in any one of the FIGS. 9–13 and 33 of the drawings.

8. A display according to claim 7 wherein segments L and E are selectively energizable for displaying the numeral in Arabian writing corresponding to numeral 8 and segments L, E and M are selectively energizable for displaying the numeral in Arabian writing corresponding to numeral 5.

9. A display according to claim 7 wherein segments L and M are selectively energized when selectively displaying each of the numerals in Arabian writing corresponding respectively to numerals 4 and 5.

10. A display according to claim 7 wherein segments O, L and M are selectively energized for displaying the numeral in Arabian writing corresponding to numeral 4, segments L, M and E are selectively energized for displaying the numeral in Arabian writing corresponding to numeral 5, segments E and D are selectively energized for displaying the numeral in Arabian writing corresponding to the numeral 7, segments L and E are selectively energized for displaying the numeral in Arabian writing corresponding to numeral 8, and segments O, F and D are selectively energized for displaying the numeral in Arabian writing corresponding to numeral 9.

11. A display according to claim 7, further including the segment U selectively energized with segment E for displaying the numeral in Arabic writing corresponding to numeral 3.

12. A multiple segment display comprising a minimum of six and a maximum of seven selectively energizable segments, said segments being shaped and positioned relative to one another in a predetermined array so that each numeral of the type used in Arabian writing can be selectively displayed, wherein said array comprises segments G, H, J, L, M and N as shown in any one of the FIGS. 14–17, inclusive, 29, and 34 of the drawings.

13. A display according to claim 12, wherein segment J is selectively energized when displaying each of the numerals in Arabian writing corresponding respectively to numerals 4 and 9.

14. A display according to claim 12 wherein segments L and N are selectively energized when displaying each of the numerals in Arabian writing corresponding respectively to numerals 5 and 8.

15. A display according to claim 14 wherein segments H and N are selectively energizable for displaying the numeral in Arabian writing corresponding to numeral 2, segments J, L and M are selectively energizable for displaying the numeral in Arabian writing corresponding to numeral 4, segments N and G are selectively energized for displaying the numeral in Arabian writing corresponding to numeral 7, segments L and N are selectively energized for displaying the numeral in Arabian writing corresponding to numeral 8, and segments J and L are selectively energized for displaying the numeral in Arabian writing corresponding to numeral 9.

16. A display according to claim 14 further including segment U selectively energizable with segment N for displaying the numeral in Arabian writing corresponding to the numeral 3.

17. A multiple segment display comprising a minimum of six and a maximum of seven selectively energizable segments, said segments being shaped and positioned relative to one another in a predetermined array so that each numeral of the type used in Arabian writing can be selectively displayed, wherein said array comprises segments A, B, C, D, I and R as shown in any one of FIGS. 19–23, inclusive, and 30 of the drawings.

18. A display according to claim 17 wherein segments A and D are selectively energized when displaying each numeral in Arabian writing corresponding respectively to numerals 6 and 9.

19. A display according to claim 17 wherein segment I is selectively energized when displaying each numeral in Arabian writing corresponding respectively to numerals 4 and 5.

20. A display according to claim 17 wherein segments A, B, and I are selectively energized for displaying the numeral in Arabian writing corresponding to numeral 4, segments I and R are selectively energized for displaying the numeral in Arabian writing corresponding to numeral 5, segments R and D are selectively energized for displaying the numeral in Arabian writing corresponding to numeral 7, segments C and D are selectively energized for displaying the numeral in Arabian writing corresponding to numeral 8 and segments A, B, C, and D are selectively energized for displaying the numeral in Arabian writing corresponding to numeral 9.

21. A display according to claim 17 wherein segment D is selectively energized when displaying each of the numerals in Arabian writing corresponding respectively to numerals 7 and 8.

22. A multiple segment display comprising seven selectively energizable segments, said segments being shaped and positioned relative to one another in a predetermined array so that each numeral of the type used in Arabian writing can be selectively displayed, wherein said array comprises segments I, R, D, Q, O, F and AA of FIG. 24 of the drawings.

23. A display according to claim 22 wherein segment D is selectively energized when displaying each numeral in Arabian writing corresponding respectively to numerals 7 and 8.

24. A display according to claim 22 wherein segment I is selectively energized when displaying each of the numerals in Arabian writing corresponding respectively to numerals 9 and 4.

25. A display according to claim 22 wherein segment O is selectively energized when displaying each numeral in Arabian writing corresponding respectively to numerals 9 and 4.

26. A display according to claim 22 wherein segment R is selectively energized when displaying each numeral in Arabian writing corresponding respectively to numerals 5 and 7.

27. A display according to claim 22 wherein segments O and I are selectively energized for displaying the numeral in Arabian writing corresponding to numeral 4, segments I and R are selectively energized for displaying the numeral in Arabian writing corresponding to numeral 5, segments R and D are selectively energized for displaying the numeral in Arabian writing corresponding to numeral 7, segments D and AA are selectively energized for displaying the numeral in Arabian writing corresponding to numeral 8, and segments O and F are selectively energized for displaying the numeral in Arabian writing corresponding to numeral 9.

28. A multiple segment display comprising a minimum of six and a maximum of seven selectively energizable segments, said segments being shaped and positioned relative to one another in a predetermined array so that each numeral of the type used in Arabian writing can be selectively displayed, wherein said array comprises segments I, R, T, D, F and S of any one of the FIGS. 25–28, inclusive, and 31 of the drawings.

29. A display according to claim 28 wherein segment R is selectively energized when displaying each of the numerals in Arabian writing corresponding respectively to numerals 2, 3, 5 and 7.

30. A display according to claim 28 wherein segments D and R are selectively energized for displaying the numeral in Arabian writing corresponding to numeral 7.

31. A display according to claim 28 wherein segment I is selectively energized when displaying each of the numerals in Arabian writing corresponding respectively to numerals 4 and 5.

32. A display according to claim 28 wherein segments I and R are selectively energized for displaying the numeral in Arabian writing corresponding to numeral 5 and segments R and D are selectively energized for displaying the numeral in Arabian writing corresponding to numeral 7.

* * * * *